US009867448B2

(12) United States Patent
Apodaca

(10) Patent No.: US 9,867,448 B2
(45) Date of Patent: Jan. 16, 2018

(54) CONTAINER WITH COLLAPSIBLE APPLICATOR

(71) Applicant: HCT GROUP HOLDINGS LIMITED, Central (HK)

(72) Inventor: Adrian Charles Apodaca, Daly City, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 114 days.

(21) Appl. No.: 14/854,230

(22) Filed: Sep. 15, 2015

(65) Prior Publication Data

US 2016/0075475 A1 Mar. 17, 2016

Related U.S. Application Data

(60) Provisional application No. 62/050,444, filed on Sep. 15, 2014.

(51) Int. Cl.
*B65D 21/08* (2006.01)
*A45D 40/26* (2006.01)
(Continued)

(52) U.S. Cl.
CPC ..... *A45D 40/26* (2013.01); *A45D 33/006* (2013.01); *A45D 33/008* (2013.01); *A45D 33/18* (2013.01);
(Continued)

(58) Field of Classification Search
CPC .... A45D 40/26; A45D 33/006; A45D 33/008; A45D 33/18; A45D 40/221; A45D 2200/1009
(Continued)

(56) References Cited

U.S. PATENT DOCUMENTS

D35,976 S 7/1902 McCormick
1,527,052 A 2/1925 McAndrews
(Continued)

FOREIGN PATENT DOCUMENTS

CN 2606543 Y 3/2004
CN 1499988 A 5/2004
(Continued)

OTHER PUBLICATIONS

Affidavit of Armando Villarreal, State of California, County of Los Angeles, Mar. 19, 2013, 4 pages.
(Continued)

*Primary Examiner* — Chun Cheung
(74) *Attorney, Agent, or Firm* — Seager, Tufte & Wickhem LLP

(57) ABSTRACT

A container is provided that includes a base having a plurality of sides defining abase perimeter and a well configured to hold a product. The container also includes a lid assembly configured to be pivotably coupled to the base and a recess disposed on two or more of the plurality of sides. The recess has a height extending between a top and bottom of the base and a width extending between the base perimeter and the well. The container further includes a collapsible applicator configured to be: (i) held within the recess at two or more of the plurality of sides when the collapsible applicator is in a collapsed position; and (ii) removed from the recess at the two or more sides and extended from the collapsed position to an extended application position.

12 Claims, 6 Drawing Sheets

(51) Int. Cl.
*A45D 40/22* (2006.01)
*A45D 33/00* (2006.01)
*A45D 33/18* (2006.01)

(52) U.S. Cl.
CPC .... *A45D 40/221* (2013.01); *A45D 2200/1009* (2013.01)

(58) Field of Classification Search
USPC ..... 206/581
See application file for complete search history.

(56) References Cited

U.S. PATENT DOCUMENTS 1,748,491 A 2/1930 May
D83,668 S 3/1931 Shebinin
D94,984 S 3/1935 Noble
D139,903 S 1/1945 Baff
2,459,733 A 1/1949 Macy
2,600,426 A 6/1952 Paul
2,755,968 A 7/1956 Fiant
2,982,987 A 5/1961 Knapp
3,130,433 A 4/1964 John
3,183,538 A 5/1965 Otto
3,337,901 A 8/1967 Schefer et al.
3,476,123 A 11/1969 Flax
3,602,601 A 8/1971 Zenger et al.
3,644,707 A 2/1972 Costello
3,710,985 A 1/1973 Baum
3,733,634 A 8/1973 Golbe
3,774,231 A 11/1973 Tullos
3,886,618 A 6/1975 Paoletti
3,891,827 A 6/1975 Wyse
4,027,348 A 6/1977 Flowers
4,029,422 A 6/1977 Pillsbury
4,056,707 A 11/1977 Farnam
4,165,755 A 8/1979 Cassai
4,182,497 A 1/1980 Ferreira
4,291,685 A 9/1981 Taelman
4,312,333 A 1/1982 Dreybus
D268,292 S 3/1983 Chevassus
D269,067 S 5/1983 Ballereaud
4,421,127 A 12/1983 Geer
4,446,880 A 5/1984 Gueret et al.
4,465,073 A 8/1984 Schwob
4,470,715 A 9/1984 Reuchin
4,511,427 A 4/1985 Karliner
4,551,038 A 11/1985 Baker
D281,731 S 12/1985 Phu
4,579,133 A * 4/1986 Seidler ..... A45D 33/006 132/317
4,592,745 A 6/1986 Rex et al.
4,602,741 A 7/1986 Faulkner, III et al.
4,603,448 A 8/1986 Middleton et al.
4,704,088 A 11/1987 Newman
4,708,267 A 11/1987 Sieverding et al.
D293,612 S 1/1988 Bulwik
D293,834 S 1/1988 White et al.
D293,944 S 1/1988 Trabattoni
D301,771 S 6/1989 Bakic
4,869,612 A 9/1989 Mooney et al.
4,874,117 A 10/1989 Kay et al.
4,880,326 A 11/1989 Spivey
D307,191 S 4/1990 Blutenthal
4,917,132 A 4/1990 Tuchman
4,941,226 A 7/1990 Kemper
4,983,059 A 1/1991 Holloway
5,005,697 A 4/1991 Jimbo et al.
D316,763 S 5/1991 Ferrari
5,025,960 A 6/1991 Seager
5,116,154 A 5/1992 Fulkerson
5,180,244 A 1/1993 Hirose
5,316,196 A 5/1994 Reich
5,353,818 A 10/1994 Suzuki et al.
D353,100 S 12/1994 Mandel
D353,101 S 12/1994 Desgrippes
5,431,176 A 7/1995 Favre
D361,159 S 8/1995 Feng
D365,892 S 1/1996 Markham
5,531,763 A 7/1996 Mastri et al.
5,603,340 A 2/1997 Gueret
5,626,472 A 5/1997 Pennetta
5,655,553 A 8/1997 Giese et al.
5,690,441 A 11/1997 McManus
D386,972 S 12/1997 Stoecker
5,713,471 A 2/1998 Gueret
5,813,420 A 9/1998 Sussman
5,816,728 A 10/1998 Nardolillo et al.
5,839,626 A 11/1998 Gross et al.
D405,013 S 2/1999 Schaeffer
5,875,795 A 3/1999 Bouix
5,896,866 A 4/1999 Quennessen
5,906,214 A * 5/1999 Gueret ..... A45D 34/045 132/314
5,951,185 A 9/1999 Kingsford et al.
5,976,616 A 11/1999 Wayne
6,009,887 A 1/2000 Hertel
6,027,272 A 2/2000 Spencer
D422,120 S 3/2000 Orsomando
D425,669 S 5/2000 Gavin
D425,794 S 5/2000 Grossnickle
6,059,474 A 5/2000 Huang
6,062,757 A * 5/2000 Gueret ..... A45D 40/24 401/122
6,068,421 A 5/2000 Pierpont
D428,209 S 7/2000 Kudo et al.
6,102,518 A 8/2000 Taylor
6,102,602 A 8/2000 Kageyama
6,119,891 A 9/2000 Favre
D432,724 S 10/2000 Gavin
6,129,469 A 10/2000 Messer et al.
6,138,686 A 10/2000 Yuhara
6,139,553 A 10/2000 Dotan
D434,875 S 12/2000 Gavin
6,164,857 A 12/2000 Wolfarth-Brooks et al.
6,173,719 B1 1/2001 Petit
D439,019 S 3/2001 Motosko
D439,376 S 3/2001 Lerolle et al.
6,202,902 B1 3/2001 Starr
D442,868 S 5/2001 Gavin
6,261,014 B1 7/2001 Altobellis et al.
6,287,034 B1 9/2001 Miraglia et al.
6,290,416 B1 9/2001 Gueret
6,298,863 B1 * 10/2001 Byun ..... A45D 40/22 132/294
6,315,479 B1 11/2001 Sakurai
6,336,460 B2 1/2002 Yuhara
6,354,308 B1 3/2002 Kuk
D457,687 S 5/2002 Millar
D457,986 S 5/2002 Rodriguez et al.
6,402,411 B2 6/2002 Spencer et al.
D468,058 S 12/2002 Thorpe
D471,108 S 3/2003 Calderone, Jr.
6,565,523 B1 5/2003 Gabourie
6,607,323 B2 8/2003 Breidenbach et al.
D479,630 S 9/2003 Lai
D481,319 S 10/2003 Orsomando
6,669,389 B2 12/2003 Gueret
D485,018 S 1/2004 Beilman
D487,703 S 3/2004 Orsomando
6,789,970 B1 9/2004 Shearon et al.
D498,024 S 11/2004 Leppla et al.
D498,146 S 11/2004 Densky et al.
D498,422 S 11/2004 Theunynck
D503,245 S 3/2005 Vanoncini
6,872,020 B2 3/2005 Epli
D505,518 S 5/2005 Benjamin et al.
D507,078 S 7/2005 Greenfield
6,923,589 B2 8/2005 Blackwell
6,942,412 B2 9/2005 Gueret
D513,873 S 1/2006 Bochno et al.
6,997,321 B2 2/2006 Young
7,040,830 B2 5/2006 Kliegman
7,082,970 B2 8/2006 Bartholomew
7,083,347 B2 8/2006 Marcotte

(56) References Cited

U.S. PATENT DOCUMENTS

D532,936 S 11/2006 Bakic
D533,309 S 12/2006 Nobuto et al.
D535,104 S 1/2007 Chen
D535,441 S 1/2007 Maddy
7,172,357 B2 2/2007 Gueret
D538,480 S 3/2007 Chen
D539,481 S 3/2007 Lui
7,240,402 B2 7/2007 Suzuki et al.
D551,987 S 10/2007 Kuethe et al.
D554,291 S 10/2007 Darnell et al.
D554,292 S 10/2007 Thorpe
D554,293 S 10/2007 Thorpe
D554,294 S 10/2007 Thorpe
7,282,037 B2 10/2007 Cho
D554,804 S 11/2007 Bernard
D555,831 S 11/2007 Chan
7,306,442 B2 12/2007 Fox
7,334,685 B2 2/2008 Mathiez
D564,707 S 3/2008 Barresi
7,337,787 B2 3/2008 Matsuoka
D566,899 S 4/2008 De Baschmakoff
D570,545 S 6/2008 Althoff et al.
7,398,898 B2 7/2008 Bouix
D576,354 S 9/2008 Dominski et al.
D576,770 S 9/2008 Mascotte et al.
7,429,141 B2 9/2008 Habatjou
D581,597 S 11/2008 Martinez
D586,504 S 2/2009 Moon
7,494,030 B2 2/2009 Bennett
D592,956 S 5/2009 Thiellier
D595,900 S 7/2009 Yamamoto
D600,857 S 9/2009 Maddy et al.
7,614,404 B2 11/2009 Kee
7,614,405 B2 11/2009 Allen et al.
7,638,144 B2 12/2009 Rhaodes
D611,657 S 3/2010 Maddy et al.
D616,608 S 5/2010 Maddy
D617,050 S 6/2010 Lou
7,785,026 B2 8/2010 Eng
D626,289 S 10/2010 Lee
7,828,000 B2 11/2010 Lee
7,832,564 B2 11/2010 Kim
D632,014 S 2/2011 Lee
7,883,287 B2 2/2011 Thorpe
D633,653 S 3/2011 Lee
7,927,032 B2 4/2011 Sanchez
7,959,369 B2 6/2011 Gueret
D642,333 S 7/2011 Praster
D645,617 S 9/2011 Mahdavi
8,028,707 B2 10/2011 Wyatt et al.
8,074,665 B2 12/2011 Pires
D653,805 S 2/2012 Tani
D655,046 S 2/2012 Nakamura
D656,824 S 4/2012 Haile
8,161,983 B1 4/2012 Lee
D663,483 S 7/2012 Lee
D666,773 S 9/2012 Greenfield
8,267,606 B2 9/2012 Delbove et al.
8,292,535 B2 10/2012 Thorpe
8,360,674 B2 1/2013 Dwyer
D678,074 S 3/2013 De France
D679,604 S 4/2013 Sung
D688,420 S 8/2013 Lai
D693,059 S 11/2013 Tani
8,573,874 B2 11/2013 Neuner
8,590,545 B2 11/2013 Won
D696,816 S 12/2013 Kordulla et al.
D698,256 S 1/2014 Thompson
D704,066 S 5/2014 de Lima Paschoal et al.
D705,074 S 5/2014 Della Valle
D705,663 S 5/2014 Guichot
D714,157 S 9/2014 Albertini
D715,653 S 10/2014 Lavigne et al.
D716,148 S 10/2014 DeMarco et al.
8,864,401 B2 10/2014 Duru
D723,220 S 2/2015 Guor
D728,860 S 5/2015 Blanch
D743,101 S 11/2015 Pires et al.
9,247,803 B2 * 2/2016 Lim ..... A45D 33/006
2001/0047949 A1 12/2001 Bono
2002/0029859 A1 3/2002 Weaver
2002/0082625 A1 6/2002 Huxel et al.
2002/0096185 A1 7/2002 Givens
2002/0121239 A1 9/2002 Tonazzi et al.
2002/0162565 A1 11/2002 Sebban
2002/0166631 A1 11/2002 Dewitt
2002/0185396 A1 12/2002 Mainwaring et al.
2003/0060925 A1 3/2003 Bartholomew et al.
2003/0129363 A1 7/2003 Hoeft et al.
2003/0171762 A1 9/2003 Forchette et al.
2003/0231924 A1 12/2003 Libman et al.
2004/0018037 A1 1/2004 Gueret
2004/0034315 A1 2/2004 Chen
2004/0127952 A1 7/2004 O'Phelan et al.
2004/0190975 A1 9/2004 Goodman et al.
2004/0206370 A1 10/2004 Byun
2004/0211789 A1 10/2004 Osborn et al.
2004/0222124 A1 11/2004 Byun
2004/0249320 A1 12/2004 Yamazaki et al.
2005/0000534 A1 1/2005 Tien
2005/0047848 A1 3/2005 Carraher
2005/0175786 A1 8/2005 Singh et al.
2005/0197268 A1 9/2005 Buskirk et al.
2005/0249539 A1 11/2005 Habatjou
2005/0268409 A1 12/2005 Blaustein et al.
2006/0027481 A1 2/2006 Gelardi et al.
2006/0032512 A1 2/2006 Kress et al.
2006/0039742 A1 2/2006 Cable, Jr. et al.
2006/0049203 A1 3/2006 Boone et al.
2006/0072956 A1 4/2006 Tanaka et al.
2006/0093425 A1 5/2006 Gueret
2006/0093426 A1 5/2006 Tsaur
2006/0118454 A1 6/2006 Kang, III
2006/0198686 A1 9/2006 Hetzel
2006/0207627 A1 9/2006 Thorpe et al.
2006/0216104 A1 9/2006 Bouix et al.
2006/0216256 A1 9/2006 Giniger et al.
2006/0272668 A1 12/2006 Wyatt et al.
2006/0275072 A1 12/2006 Petit
2007/0029226 A1 2/2007 Yuhara et al.
2007/0034224 A1 2/2007 Dumler
2007/0116509 A1 5/2007 Lin
2007/0131240 A1 6/2007 Prague
2007/0186950 A1 8/2007 Roeder
2007/0186951 A1 8/2007 Gueret
2007/0235056 A1 10/2007 Vintimiglia et al.
2007/0272269 A1 11/2007 Wyatt et al.
2007/0289602 A1 12/2007 Simmons
2008/0023023 A1 1/2008 Boye
2008/0060668 A1 3/2008 Legassie
2008/0138138 A1 6/2008 Gueret
2008/0166172 A1 7/2008 Eng et al.
2008/0193193 A1 8/2008 Pechko et al.
2008/0286030 A1 11/2008 Roder
2008/0302384 A1 12/2008 Parker
2009/0071499 A1 3/2009 Wyatt et al.
2009/0194120 A1 8/2009 Pires et al.
2009/0194127 A1 8/2009 Pires et al.
2009/0272399 A1 11/2009 Kim, II
2009/0288677 A1 11/2009 Chen
2009/0293902 A1 12/2009 Ramos
2009/0320874 A1 12/2009 Boye et al.
2010/0031971 A1 2/2010 Ha
2010/0037407 A1 2/2010 Telwar
2010/0178095 A1 7/2010 Bouix
2010/0215422 A1 8/2010 Carroll et al.
2010/0224208 A1 9/2010 Thorpe et al.
2010/0288299 A1 11/2010 Won
2010/0300474 A1 12/2010 Tsai
2010/0307530 A1 12/2010 Bennett
2011/0042378 A1 2/2011 Dibnah et al.
2011/0123248 A1 5/2011 Kim
2011/0123252 A1 5/2011 Thorpe
2011/0176854 A1 7/2011 Nobles

(56) References Cited

U.S. PATENT DOCUMENTS

| | | | |
|---|---|---|---|
| 2011/0176856 | A1 | 7/2011 | Gardner et al. |
| 2011/0266297 | A1 | 11/2011 | Thorpe et al. |
| 2012/0014736 | A1 | 1/2012 | Pires et al. |
| 2012/0065555 | A1 | 3/2012 | Chae et al. |
| 2012/0136748 | A1 | 5/2012 | Shasteen et al. |
| 2012/0266907 | A1 | 10/2012 | Chan |
| 2012/0282008 | A1 | 11/2012 | Geuther et al. |
| 2013/0004226 | A1 | 1/2013 | Breidenbach et al. |
| 2013/0012174 | A1 | 1/2013 | Longe et al. |
| 2013/0048658 | A1 | 2/2013 | Sawata |
| 2013/0051894 | A1 | 2/2013 | Lim et al. |
| 2013/0108354 | A1 | 5/2013 | Fischer |
| 2013/0121748 | A1 | 5/2013 | Ramirez |
| 2013/0134189 | A1 | 5/2013 | Kageyama et al. |
| 2013/0255735 | A1 | 10/2013 | Banerjee |
| 2013/0284202 | A1 | 10/2013 | Limongi et al. |
| 2013/0343798 | A1 | 12/2013 | Delage et al. |
| 2013/0343800 | A1 | 12/2013 | Drugeon et al. |
| 2014/0023689 | A1 | 1/2014 | Kim et al. |
| 2014/0154295 | A1 | 6/2014 | Sim et al. |
| 2014/0219701 | A1 | 8/2014 | Eberlein |
| 2014/0234004 | A1 | 8/2014 | Thorpe |
| 2014/0234010 | A1 | 8/2014 | Thorpe et al. |

FOREIGN PATENT DOCUMENTS

| | | | |
|---|---|---|---|
| CN | 200941885 | Y | 9/2007 |
| EP | 0181184 | A2 | 5/1986 |
| EP | 2084986 | A2 | 8/2009 |
| EP | 2471406 | A1 | 7/2012 |
| FR | 1050060 | A | 1/1954 |
| FR | 2763811 | A1 | 12/1998 |
| FR | 2806272 | A1 | 9/2001 |
| FR | 2806893 | A1 | 10/2001 |
| JP | 5945015 | U | 3/1984 |
| JP | 8238884 | A | 9/1996 |
| JP | 2533414 | Y2 | 4/1997 |
| JP | 2597556 | Y2 | 7/1999 |
| JP | 2000102583 | A | 4/2000 |
| JP | 2000279870 | A | 10/2000 |
| JP | 2001000497 | A | 1/2001 |
| JP | 2005211182 | A | 8/2005 |
| JP | 2005319300 | A | 11/2005 |
| JP | 2006247037 | A | 9/2006 |
| KR | 20-1998-056332 | U | 10/1998 |
| KR | 20050000059 | A | 1/2005 |
| KR | 200398534 | Y1 | 10/2005 |
| KR | 20060026096 | A | 3/2006 |
| KR | 2020120003955 | U | 6/2012 |
| WO | 9211785 | A1 | 7/1992 |
| WO | 0108529 | A2 | 2/2001 |
| WO | 2007117091 | A1 | 10/2007 |
| WO | 2008010628 | A1 | 1/2008 |
| WO | 2011083427 | A2 | 7/2011 |
| WO | 2011086427 | A1 | 7/2011 |
| WO | 2012032148 | A1 | 3/2012 |

OTHER PUBLICATIONS

Affidavit of Jenny Hsu—Attachment F, Park, "HCT produces metal tips for latest Dior cosmetics range," Packaging News, Sep. 3, 2009, retrieved at <<http://www.packagingnews.co.ukldesign/hct-produces-metal-tips-for-latest-diorcosmetics-range/>> 2 pages.

Affidavit of Jenny Hsu—Attachment G, "Vichy Neovvadiol of Lip & Eye Contour by HCT Packaging," Packaging Europe, Jun. 2011, 2 pages.

Affidavit of Jenny Hsu—Attachment H, "Armani Turns to HCT for New Eye Serum Packs," Packaging News, Sep. 26, 2011, 2 pages.

Affidavit of Jenny Hsu—Attachment I, "Armani Chose the HCT Patented Metal Tip Applicators for Their New Eye Serum," Packaging Europe, Sep. 2011, 2 pages.

Affidavit of Jenny Hsu, Attachment A, "2009 HBA IPDA Winners Annouced" Beauty Packaging Magazine, Oct./ Nov. 2009, retrieved at <<http://www.beautypackaging.com/articles/2009/10-2009-hba-ipda-winners-announced>> 3 pages.

Affidavit of Jenny Hsu, Attachment B, "Cosmetic/Personal Care Packaging, 2009 Editor's Choice Award Winner: Personal Care," Cosmetic & Personal Care Packagining Magazine I USA, May 2009, retrieved at <<http://www.cpcpkg.com/magazine/09 05 perfekt.php>> 3 pages.

Affidavit of Jenny Hsu, Attachment C, "Cosmoprof Bologna Draws Growing International Crowd," BeautyPackaging Magazine, Apr./ May 2012, retrieved at <<http://beta.nutraceuticalsworld.comarticles/20 12/05/cosmoprof-bologna-draws-growinginternational-crow>> 2 pages.

Affidavit of Jenny Hsu, Attachment D, "HCT's patented cooling tip technology wins award for Clinique Lid Smoothies" BeautyPackaging Magazine, Oct. 2012, Press release, HCT Innovation on demand, 3 pages.

Affidavit of Jenny Hsu, Attachment E, "HCT Develops Dispensing Concept: Zamac Tips Add a High Dose of Cool," Beauty Packaging Magazine, Oct./Nov. 2009, retrieved at <<http://www.beautypackaging.com/articles/2009/1O/design-center>> 3 pages.

Affidavit of Jenny Hsu, including Exhibits A-I, State of California, county of Lost Angeles, Jan. 2013, 26 pages.

"Blistex—Lip Splash, Rolling Tip Applicator, Lip Moisturizer, SPF for Your Lips, Bermat . . .", retrieved on May 10, 2007 at <http://www.blistex.eu/whats_new.htm>, 1 page.

"Communication Accompanying Information Disclosure Statement," for U.S. Appl. No. 13/656,993, Timothy Thorpe, "Dispenser With Thermal Storage Tip," May 14, 2013, 2 pages.

"Cosmogen Innovation in Progress," retrieved on Jun. 20, 2008, 1 page.

"Energizer L91 Ultimate Lithium", Product Datasheet, retrieved on Feb. 5, 2013, at <<Htpp://data.energizer.com/PDFs/I91.pdf>>, Energizer Holdings, Inc., pp. 1-2.

"Frequently Asked Questions About Our Cooling and Heating Technology", retrieved on Feb. 5, 2013, at <<http://www.tellurex.com/technology/peltier-gaq.php>>, Tellurex, 2009-2011, pp. 1-14.

HCT Answer Brief to Third Korean Invalidation Brief (Summary Translation), filed Apr. 29, 2013, 7 pages.

Lancome Oscillation Powderfoundation, retrieved on Mar. 8, 2010, at <<http://www.lancome-usa.com/makeup/ foundations/oscillation-powerfoundation,aspx>>, p. 1 of 1.

"Part Number: CP Series, Description: application notes", V-Infinity, a division of CUI, Inc., Jan. 2009, pp. 1-8.

Response to Korean Invalidation Petition (and Summary Translation) in response to Invalidation Action filed in reference to Korean Patent No. 800040, dated Mar. 25,040, dated Mar. 25, 2013, 60 pages.

Response to Non-Final Office Action for U.S. Appl. No. 11/747,078, dated Sep. 16, 2010, Timothy Thorpe, "Dispenser with Thermal Storage Tip," 10 pages.

Response to Non-Final Office Action for U.S. Appl. No. 13/022,193, dated Jul. 30, 2012, Timothy Thorpe, "Dispenser with Thermal Storage Tip," 18 Pages.

Sephora, Urban Decay Cosmetics, retrieved on Mar. 11, 2010 at <<http://www.sephora.com/browse/product.jhtml?Id=P204729 &cm_mmc=us_search-__-GoogleBase-__-P204729-__-1051143 &__requestedid=42976&ci__src=14110944&ci__src=14110944 &ci__sku=1051143>>, 5 pages.

"Series: CP20, Description:2.0 A Peltier Module", retrieved on Feb. 5, 2013 at <<http://cui.com/Product/Resource/PDF/CP20.pdf>>, CUI,Inc May 7, 2012, pp. 1-5.

"Super simple PWM TEC controller", retrieved on Feb. 5, 2013, at <<http://redlum.xohp.pagesperso-orange.fr/electronics/ simplePWM-TEC.html>>, Welcom to W's Laser-Projects Page!., Vers. 1.0, Aug. 2010. pp. 1-3.

The Notice: a beauty blog "Too much of a good thing is still totally a good thing. | Clinique Almost Lipstick review, photos, swatches (Spring 2012 full lineip)" Posted Gebruary 25, 2012. Accessed on Aug. 17, 2015. (http://thenotice.net/2012/02/clinique-almost-lipstick-review/).

The Ultimate Makeup blog "Review & Swatches: NARS Fall 2011 Pure Matter Lipsticks in Montego Bay & Mascate" Posted Aug. 12,

(56) References Cited

OTHER PUBLICATIONS

2011. Accessed on Aug. 17, 2015. (http://theultimatemakeup.com/post/8833814342/review-swatches-nars-fall-2011-pure-matte).
Top Skin Care Products, Facial Skin Care, Skin Care Brush—Claisonic, retrieved on Mar. 8, 2010 <http://www.clarisonic.com/us/>>, pp. 1-2.
Translated First Korean Invalidation Brief dated Nov. 2, 2012, 7 pages.
Translated Second Korean Invalidation Brief, dated Jan. 23, 2013, 7 pages.
Translated Third Korean Invalidation Brief, dated Mar. 28, 2013, 30 pages.
Response to Final Office Action for U.S. Appl. No. 11/747,078, dated Oct. 28, 2010, Timothy Thorpe, "Dispenser with Thermal Storage Tip," 10 pages.
International Application No. PCT/US2015/050173, "International Search Report and the Written Opinion of the International Searching Authority" dated Jan. 11, 2016.
Freitas, Jr., Nanomedicine, Images, Foresight Institute, 1 page, Feb. 11, 2001.
Hobson, "Mechanical Iris Will Make You Want a Laser Cutter Even More", Hackday.com, 10 pages, Mar. 24, 2014.
Lorac Pro Cream Eyeliner + Brush: Eyeliner, retrieved on May 29, 2013, at <<http://www.sephora.com/pro-creameyeliner-brush-P374705?skuId=1432400>> 4 pages.
Nest-filler, retrieved on May 5, 2010 at <<http://www.nest-filler.com/cosmetics/view.htm?pageno=&bimil=&idx=1328 &cate1=1220334097&cate1_1=&cate2=&cate3=,>>1 page.
Sephora Collection, Pitch BlacK All-In-1 Waterproof Eye Liner, retrieved on May 29, 2013 <<http://www.sephora.com/pitch-black-all-in-1-waterproof-eye-liner-P377198?skuId=1479070>> 4 pages.

* cited by examiner

CONTAINER WITH COLLAPSIBLE APPLICATOR

RELATED APPLICATIONS

This application claims the benefit of U.S. Provisional Application No. 62/050,444, filed Sep. 15, 2014.

TECHNOLOGY FIELD

The present application relates generally to a container having an applicator to apply a product held by the container, and in particular, to a container having a collapsible applicator removably coupled to the container. In particular embodiments, the container having a collapsible applicator is a container adapted for cosmetics, such as foundation, blush, eye shadow, mascara, lip gloss, and the like.

BACKGROUND

Conventional vessels or containers exist that are portable, convenient to use, and designed to contain products for use. These types of portable vessels usually consist of a base assembly and a lid assembly, that when assembled together provide an effective barrier for containing the products. The base and/or lid are typically made of a glass, aplastic, a metal, combinations of the foregoing, or the like.

Such conventional vessels are used in the cosmetics and personal care industries for containing products to be applied to a body. Some vessels include applicators, such as brushes, to apply the products. The vessels having applicators are typically small in size to facilitate their portability and convenience of use while also configured to hold as much amount of product as possible. Although portable vessels exist, there is a continuing need for more and different vessels.

SUMMARY

Embodiments provide a container that includes a base having a plurality of sides defining abuse perimeter and having a well configured to hold a product. The container also includes a lid assembly configured to be pivotably coupled to the base and a recess disposed on two or more of the plurality of sides. The recess has a height extending between a top and bottom of the base and a width extending between the base perimeter and the well. The container further includes a collapsible applicator configured to be: (i) held within the recess at two or more of the plurality of sides when the collapsible applicator is in a collapsed position; and (ii) removed from the recess at the two or more sides and extended from the collapsed position to an extended application position.

According to one embodiment, the collapsible applicator includes a plurality of sections that are configured to move relative to each other. When the collapsible applicator is in the collapsed position within the recess, each of the plurality of sections is adjacent to one of the two or more sides.

According to another embodiment, the collapsible applicator includes a plurality of sections configured to move relative to each other and one or more pivot elements joining adjacent sections of the plurality of sections. Each of the plurality of sections is configured to move relative to each other about the one or more pivot elements.

In an aspect of an embodiment, the one or more pivot elements include a plurality of hinged elbows configured to facilitate the movement of each of the plurality of sections relative to each other.

In one embodiment, the base is rectangular and has a front side, a rear side opposing the front side, a right side and a left side opposing the right side. The recess disposed on the rear side, the right side and the left side and the collapsible applicator are configured to be: (i) held within the recess at the rear side, the right side and the left side when the collapsible applicator is in a collapsed position; and (ii) removed from the recess at the rear side, the right side and the left side and extended from the collapsed position to an extended application position.

In another embodiment, the collapsible applicator includes a first end section, a second end section and a middle section each configured to move relative to each other. The collapsible applicator also includes a first hinged elbow joining the first end section and the middle section and a second hinged elbow joining the second end section and the middle section. The middle section is held within the recess at the rear side when the collapsible applicator is in the collapsed position. The first end section is held within the recess at the right side when the collapsible applicator is in the collapsed position and the second end section is held within the recess at the left side when the collapsible applicator is in the collapsed position.

According to one embodiment, the container further includes another collapsible applicator configured to be: (i) held within the recess at two or more of the plurality of sides when in the collapsed position; and (ii) removed from the recess at the two or more of the plurality of sides and extended from the collapsed position to the extended application position.

Embodiments provide a container that includes a base having a well configured to hold a product and comprising a side extending between a base top and a base bottom, the side defines a base perimeter. The container also includes a lid assembly configured to be pivotably coupled to the base and a recess disposed on a portion of the side of the base. The recess has a height at the base perimeter extending between the top and the bottom of the base and the lid assembly and width extending between the base perimeter and the well. The container further includes a collapsible applicator configured to be: (i) held within a portion of the recess when the collapsible applicator is in a collapsed position; and (ii) removed from the portion of the recess and extended to an extended application position.

In one aspect, the base is circular. In another aspect, the base is oval.

According to one embodiment, the collapsible applicator further includes a plurality of sections configured to move relative to each other and one or more pivot elements joining adjacent sections of the plurality of sections. Each of the plurality of sections is configured to move relative to each other about the one or more pivot elements.

According to one embodiment, the one or more pivot elements include a plurality of corrugations configured to facilitate the applicator being collapsed between the collapsed position and the extended application position.

In one embodiment, the container further includes another collapsible applicator configured to be: (i) held within another portion of the recess when in the collapsed position; and (ii) removed from the other portion of the recess at and extended from the collapsed position to the extended application position.

In one embodiment, the container further includes another recess disposed on another portion of the side of the base. The other recess is spaced from the recess. The container also includes another collapsible applicator configured to be: (i) held within the other recess when in the collapsed position; and (ii) removed from the other recess and extended from the collapsed position to the extended application position.

Embodiments provide a collapsible applicator for use with a container. The collapsible applicator includes a first section and a second section. The collapsible applicator also includes a first pivot element joining the first section and the second section. The first section and the second section are configured to move relative to each other about the pivot element. The first section and the second section are configured to be: (i) held within a recess disposed at two or more of a plurality of sides of a base of the container when the collapsible applicator is in a collapsed position; and (ii) removed from the recess at the two or more sides and extended from the collapsed position to an extended application position.

According to one embodiment, the one or more pivot elements include a plurality of hinged elbows configured to facilitate the movement of each of the plurality of sections relative to each other.

According to another embodiment, the one or more pivot elements include a plurality of corrugations configured to facilitate the applicator being collapsed between the collapsed position and the extended application position.

In one embodiment, the collapsible applicator further includes a third section and a second pivot element joining the third section from the second section. When the collapsible applicator is in the collapsed position, the first section of the collapsible applicator is configured to be held within the recess disposed at a right side of the container, the third section of the collapsible applicator is configured to be held within the recess disposed at a left side of the container opposing the right side of the container, and the third section of the collapsible applicator is configured to be held within the recess disposed at a rear side of the container extending between the right side and left side.

Another example container comprises:

a base comprising a plurality of sides defining a base perimeter and having a well configured to hold a product;

a lid assembly configured to be pivotably coupled to the base;

a recess disposed on two or more of the plurality of sides, the recess having a height extending between a top and bottom of the base and a width extending between the base perimeter and the well;

a collapsible applicator configured to be: (i) held within the recess at two or more of the plurality of sides when the collapsible applicator is in a collapsed position; and (ii) removed from the recess at the two or more sides and extended from the collapsed position to an extended application position.

Alternatively or additionally to any of the embodiments above, the collapsible applicator comprises a plurality of sections that are configured to move relative to each other, and when the collapsible applicator is in the collapsed position within the recess, each of the plurality of sections is adjacent to one of the two or more sides.

Alternatively or additionally to any of the embodiments above, the collapsible applicator comprises:

a plurality of sections configured to move relative to each other, and one or more pivot elements joining adjacent sections of the plurality of sections, and each of the plurality of sections is configured to move relative to each other about the one or more pivot elements.

Alternatively or additionally to any of the embodiments above, the one or more pivot elements comprise:

a plurality of hinged elbows configured to facilitate the movement of each of the plurality of sections relative to each other.

Alternatively or additionally to any of the embodiments above, the base is rectangular and having a front side, a rear side opposing the front side, a right side and a left side opposing the right side, the recess disposed on the rear side, the right side and the left side, and the collapsible applicator is configured to be: (i) held within the recess at the rear side, the right side and the left side when the collapsible applicator is in a collapsed position; and (ii) removed from the recess at the rear side, the right side and the left side and extended from the collapsed position to an extended application position.

Alternatively or additionally to any of the embodiments above, the collapsible applicator comprises:

a first end section, a second end section and a middle section each configured to move relative to each other, and a first hinged elbow joining the first end section and the middle section and a second hinged elbow joining the second end section and the middle section, wherein the middle section is held within the recess at the rear side when the collapsible applicator is in the collapsed position, the first end section is held within the recess at the right side when the collapsible applicator is in the collapsed position and the second end section is held within the recess at the left side when the collapsible applicator is in the collapsed position.

Alternatively or additionally to any of the embodiments above, further comprising:

another collapsible applicator configured to be: (i) held within the recess at two or more of the plurality of sides when in the collapsed position; and (ii) removed from the recess at the two or more of the plurality of sides and extended from the collapsed position to the extended application position.

Alternatively or additionally to any of the embodiments above, the collapsible applicator is configured to be held within the recess via a magnetic connection.

Alternatively or additionally to any of the embodiments above, the collapsible applicator is configured to slide into the recess.

Another example container comprises:

a base having a well configured to hold a product and comprising a side extending between a base top and a base bottom, the side defining a base perimeter;

a lid assembly configured to be pivotally coupled to the base;

a recess disposed on a portion of the side of the base, the recess having a height at the base perimeter extending between the top and the bottom of the base and the lid assembly and width extending between the base perimeter and the well;

a collapsible applicator configured to be: (i) held within a portion of the recess when the collapsible applicator is in a collapsed position; and (ii) removed from the portion of the recess and extended to an extended application position.

Alternatively or additionally to any of the embodiments above, the base is circular.

Alternatively or additionally to any of the embodiments above, the base is oval.

Alternatively or additionally to any of the embodiments above, the collapsible applicator further comprises:

a plurality of sections configured to move relative to each other, and one or more pivot elements joining adjacent sections of the plurality of sections, and each of the plurality of sections is configured to move relative to each other about the one or more pivot elements.

Alternatively or additionally to any of the embodiments above, the one or more pivot elements comprise a plurality of corrugations configured to facilitate the applicator being collapsed between the collapsed position and the extended application position.

Alternatively or additionally to any of the embodiments above, further comprising:

another collapsible applicator configured to be: (i) held within another portion of the recess when in the collapsed position; and removed from the other portion of the recess at and extended from the collapsed position to the extended application position.

Alternatively or additionally to any of the embodiments above, further comprising:

another recess disposed on another portion of the side of the base, the other recess spaced from the recess; and another collapsible applicator configured to be: (i) held within the other recess when in the collapsed position; and (ii) removed from the other recess and extended from the collapsed position to the extended application position.

Another collapsible applicator for use with a container comprises:

a first section;

a second section; and a first pivot element joining the first section and the second section, wherein the first section and the second section are configured to move relative to each other about the pivot element, and the first section and the second section are configured to be: (i) held within a recess disposed at two or more of a plurality of sides of a base of the container when the collapsible applicator is in a collapsed position; and (ii) removed from the recess at the two or more sides and extended from the collapsed position to an extended application position.

Alternatively or additionally to any of the embodiments above, the one or more pivot elements comprise a plurality of hinged elbows configured to facilitate the movement of each of the plurality of sections relative to each other.

Alternatively or additionally to any of the embodiments above, the one or more pivot elements comprise a plurality of corrugations configured to facilitate the applicator being collapsed between the collapsed position and the extended application position.

Alternatively or additionally to any of the embodiments above, further comprising:

a third section; and a second pivot element joining the third section from the second section, wherein when the collapsible applicator is in the collapsed position, the first section of the collapsible applicator is configured to be held within the recess disposed at a right side of the container, the third section of the collapsible applicator is configured to be held within the recess disposed at a left side of the container opposing the right side of the container, and the third section of the collapsible applicator is configured to be held within the recess disposed at a rear side of the container extending between the right side and left side.

The above summary of some embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

The foregoing and other aspects of the container having a collapsible applicator are best understood from the following detailed description when read in connection with the accompanying drawings. There is shown in the drawings embodiments that are presently preferred, it being understood, however, that the disclosure is not limited to the specific instrumentalities disclosed. Included in the drawings are the following Figures.

DETAILED DESCRIPTION OF EXEMPLARY EMBODIMENTS

Because conventional vessels having applicators are typically small in size and much of the space of the vessels is used to hold the products, the applicators included with these conventional vessels are typically small. For example, the length of a conventional applicator may be limited to the width or length of the vessels in which they are held. In some cases, users of these conventional vessels may not wish to use these applicators because of their small size. Accordingly, users may discard these small applicators and, instead, use their own brushes which are separately packaged.

Embodiments provide a container configured to hold one or more products and having a collapsible product applicator (e.g., brush) held in a recess disposed around a perimeter of the container. In some embodiments, the container includes multiple sides and the recess is disposed on at least two sides of the container. In some embodiments, the container includes a single side (e.g., circular container) and the recess is disposed on the single side of the container. In some embodiments, an applicator includes one or more pivot elements segmenting the applicator into sections configured to move about the pivot points. In some aspects of embodiments, the pivot elements include hinges. In some aspects of embodiments, the pivot elements include corrugations. In some embodiments, the pivot is provided with detents or features to maintain the applicator in an open or collapsed position until a sufficient force is applied to prevent accidental and unintended opening or collapsing. In some instances, additional stops corresponding to desirable angles may also be employed.

Figure 1:
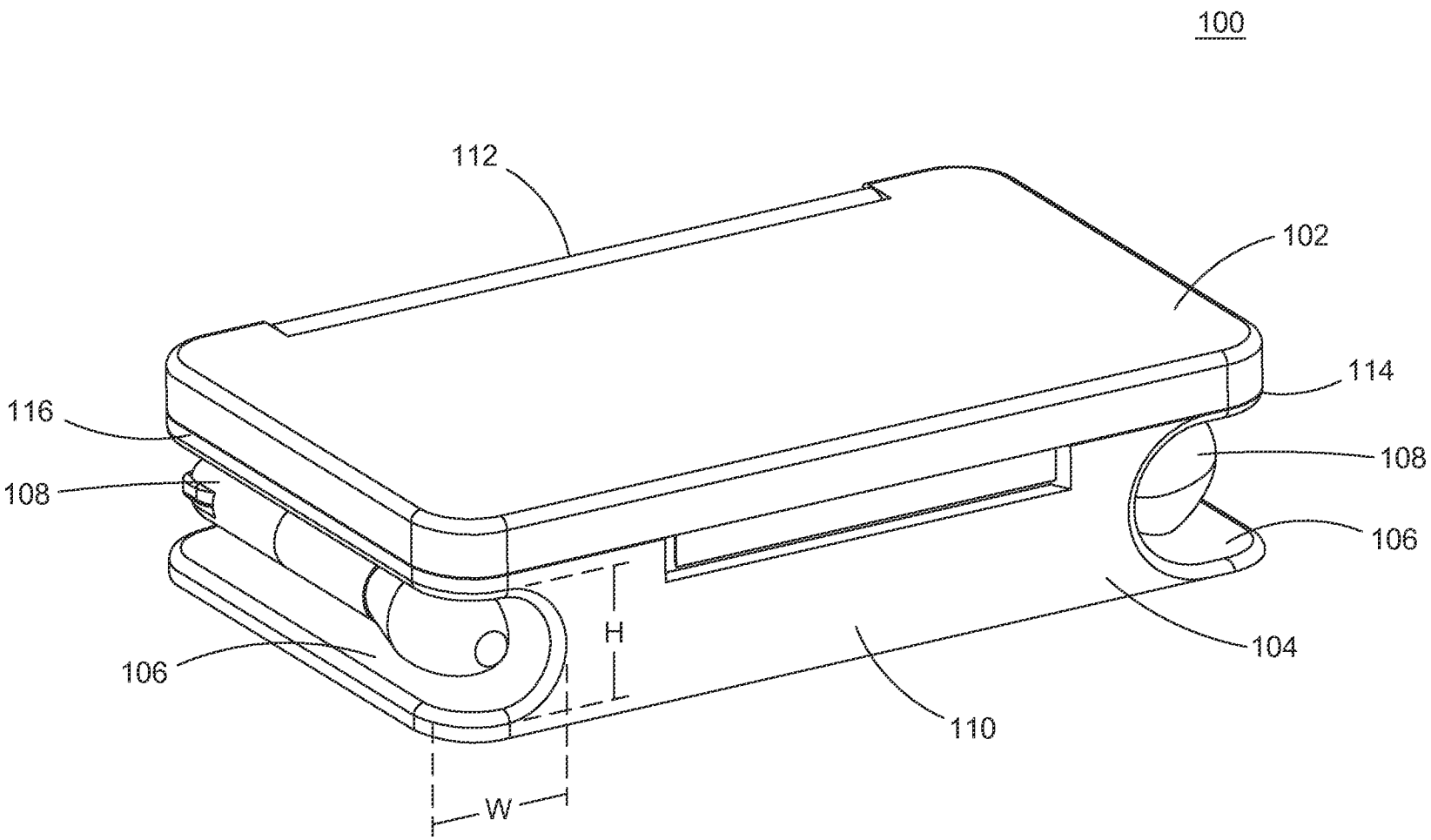
FIG. 1 is a front perspective view of a container with a collapsible applicator according to embodiments disclosed herein.
Figure 2:
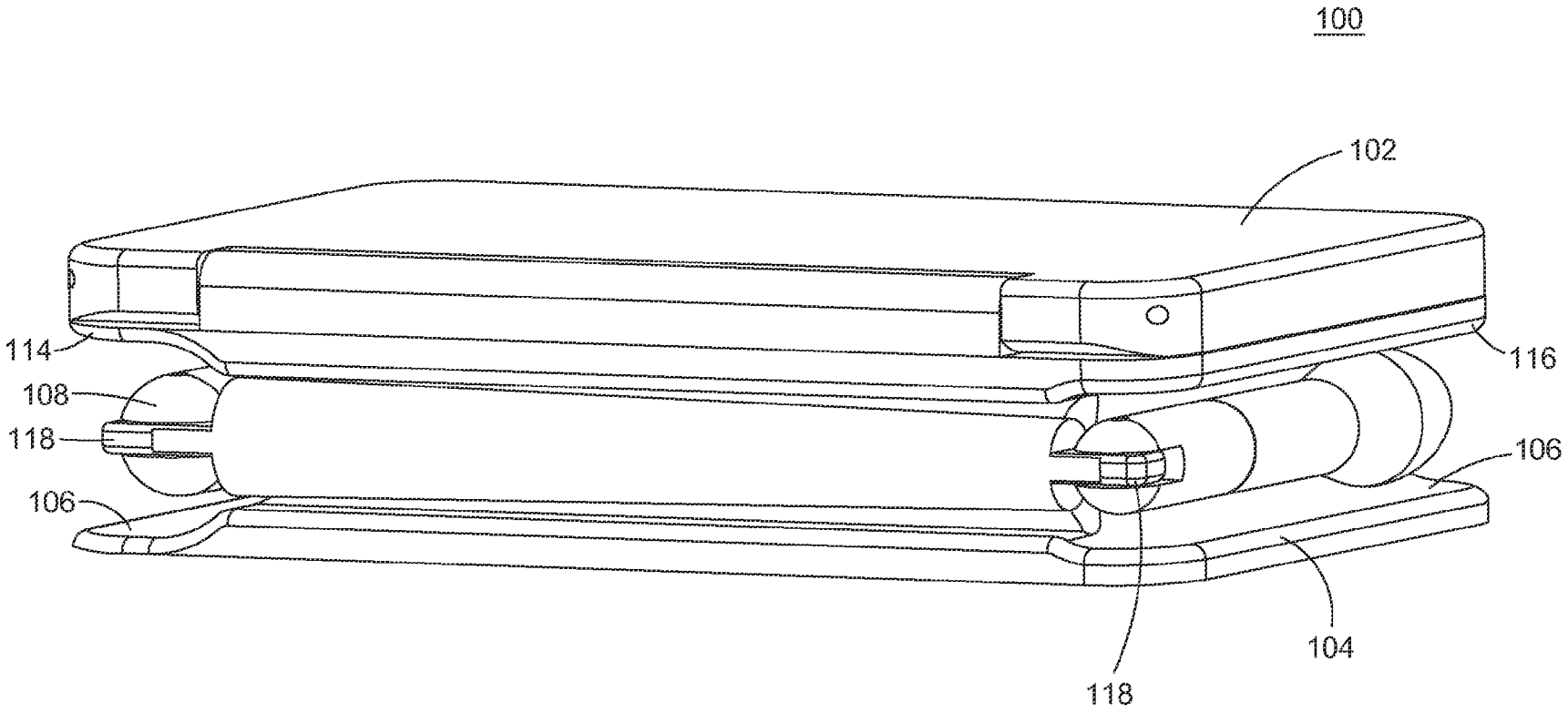
FIG. 2 is a rear perspective view of the container shown in FIG. 1.

FIG. 1 is a front perspective view of a container 100 with a collapsible applicator 108 according to embodiments disclosed herein. FIG. 2 is a rear perspective view of the container 100 shown in FIG. 1. The size and shape of the container shown in FIG. 1 and FIG. 2 is merely exemplary. As shown in FIG. 1, the container includes a lid assembly 102 and a base 104, The base 104 includes a recess 106 disposed around a perimeter of the container 100. The recess 106 is disposed on sides of the container 100 and has a recess height H extending between a top and bottom of the base 104 and a recess width W extending between the base perimeter and the well 312 (shown in FIG. 3).

The removable and collapsible applicator 108 is held within the recess 106. In some embodiments, an applicator includes one or more pivot elements joining the applicator into sections. For example, as shown in FIG. 2, the pivot elements may include hinged elbows 118 joining the applicator 108 into sections with each section disposed within a portion of the recess 106 adjacent to a corresponding side of the container 100. The sections are configured to move about the hinged elbows 118 to facilitate the applicator 108 being collapsed from an extended application position shown in FIG. 4 to a collapsed position shown in FIG. 5.

In some embodiments, however, applicators may not include hinges. For example, embodiments may include applicators made from flexible material (e.g., rubber) configured to facilitate the applicators being collapsed from an extended application position to a collapsed position. For example, embodiments may include applicators that include a plurality of corrugations configured to facilitate the applicators being collapsed from an extended application position to a collapsed position. In other embodiments, the applicators could employ a bimetallic or a memory wire to permit flexibility between the use and stored positions.

As shown in FIG. 1 and FIG. 2, the container may be rectangular in shape and the recess 106 may be disposed on a rear side 112, a right side 114 and a left side 116 of the rectangular container 100. In some embodiments, the rectangular container 100 may have a recess disposed on any number of sides. For example, the rectangular container 100 may include a recess disposed on two sides (e.g., rear side 112 and right side 114 or rear side 112 and left side 116). In some embodiments, the recess may be disposed on a single side (e.g., rear side 112) of the rectangular container 100. In some embodiments, the recess may be disposed on each of the sides (e.g., front side 110, rear side 112, right side 114 and left side 116).

In the embodiment shown at FIG. 1 and FIG. 2, the container 100 includes a single recess 106 that extends continuously on the right side 114, rear side 112 and left side 116, In some embodiments, however, containers may have multiple recesses disposed on different sides. For example, embodiments may include a rectangular container having one recess disposed on a left side and another recess disposed on a right side. In these embodiments, each recess may be used to hold a separate applicator. Similarly, in some embodiments, the recess can be disposed on three sides and house two applicators, each occupying, for example, one and a half sides. It should be appreciated that the number of applicators to be so held is limited only by the combination of size of the applicator(s) and the size of the recess(es).

The size and shape of the recess 108 shown in FIG. 1 and FIG. 2 is merely exemplary. Embodiments may include containers having other shapes and sizes. For example, containers may be shaped as another type of polygon (e.g., triangle or octagon). In some embodiments, containers may be circular having a single continuous side. In these embodiments, the container may include a single recess extending along any portion of the perimeter and may be used to hold one or more collapsible and removable applicators. In these embodiments, the container may also include multiple recesses extending along separate portions of the perimeter and may each be used to hold a collapsible and removable applicator.

The dimensions of recesses may depend on various factors, including but not limited to the dimensions of containers and the balance between space within the containers for holding products and size of the applicators.

Figure 3:
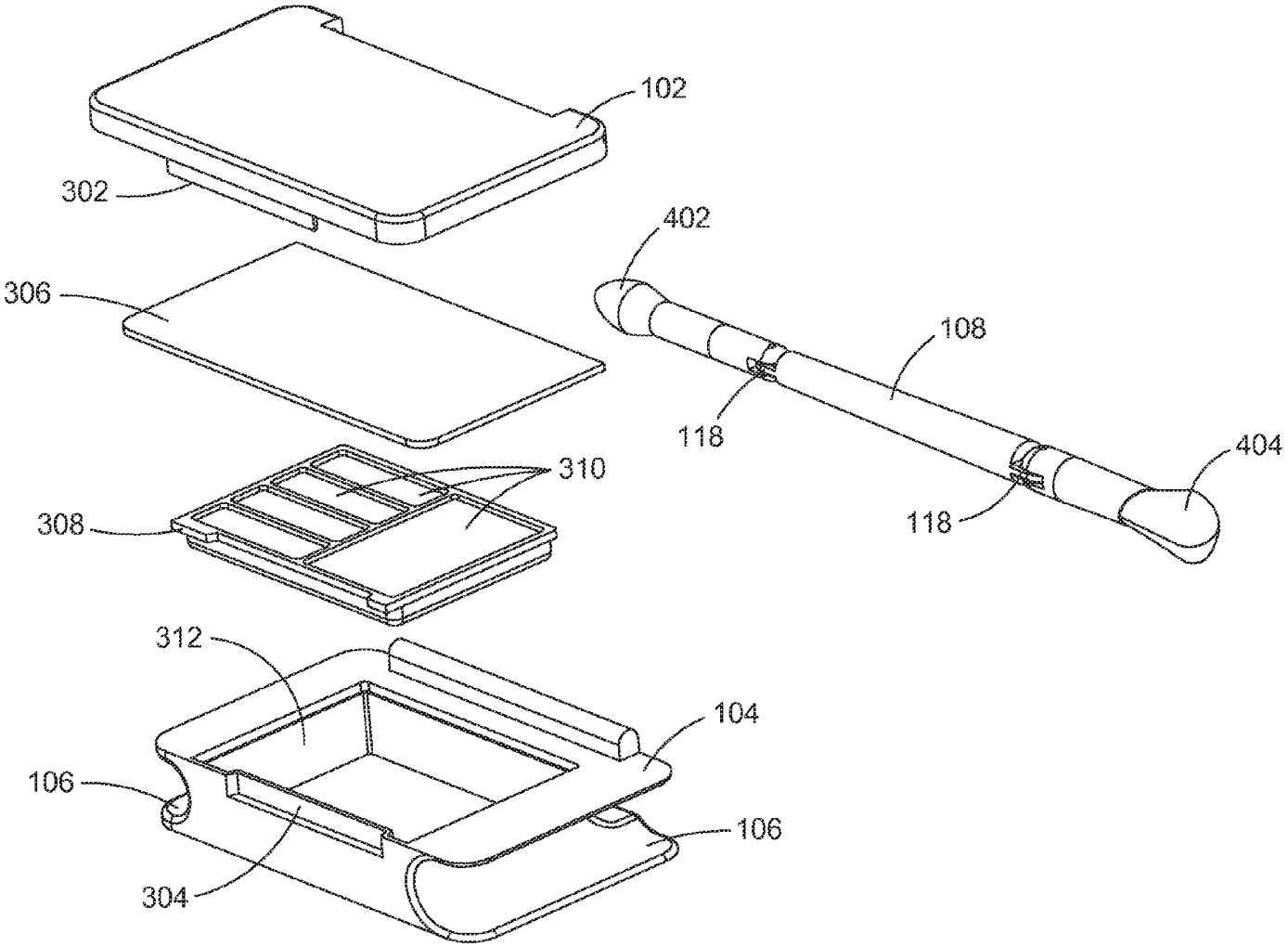
FIG. 3 is an exploded view of the container shown in FIG. 1.

FIG. 3 is an exploded view of the container shown in FIG. 1. In the embodiment shown at FIG. 1, the front side 110 does not include a recess. As shown in FIG. 3, the lid assembly 102 may include a clasp 302 disposed on the front side 104 to facilitate opening of the lid assembly 102 and the base 104 may include a clasp recess 304 configured to receive the clasp 302 and hold the lid assembly in a closed position. The container 100 may also include a mirror 306. In some embodiments, the mirror may be attached to the lid assembly 102. In other embodiments, the mirror 306 may be removable.

As shown in FIG. 3, the applicator 108 includes sections joined by the hinged elbows 118. The size and shape of the applicator 108 shown in FIG. 3 is merely exemplary. Embodiments may include applicators having different shapes and sizes. Embodiments may also include applicators having different numbers of elbows and different numbers of sections. The applicator also includes a first tip type 402 and a second tip type 404 for applying different types of products or for applying products differently. In some embodiments, the tips may be the same. In some embodiments, applicators may include a single tip. Exemplary tips include a brush, bristles, doe foot, a pad, a sponge, metal, ceramic and other types of applicators.

The container 100 may include a tray 308 having a plurality of compartments 310. The tray may be removable from well 312 in base 104. The size, shape and number of compartments 310 shown in FIG. 3 are merely exemplary. Embodiments may include any number of compartments having shapes and sizes the same or different from those shown in FIG. 3. Exemplary containers may also include any number of trays. Exemplary compartments may be used to hold any type of product, but may be particularly well suited for cosmetics that may include, but are not limited to loose powders (e.g., for eye, cheek, face, and the like), creams (e.g., skincare, eye, foundation, and the like), sunscreen, hot pour products (e.g., lipsticks, glosses, and the like), touchup, spot cover, baked powders, moisturizers, hair creams, gels, serums, and the like.

In the embodiment shown herein, the recess 106 is configured to receive and hold the removable applicator 108 via friction fitting. In some embodiments, containers may include recesses configured to receive and hold removable applicators via snap fitting. In other embodiments, containers may include recesses configured to receive and hold removable applicators via magnets.

In some embodiments, one or more portions of the removable applicator 108 may have a width less than the width of the recess 106 such that the one or more portions of the removable applicator 108 does not extend to the perimeter of the container 100, as shown in FIG. 1 and FIG. 2. In some embodiments, one or more portions of the removable applicator 108 may have a width substantially the same as the width of the recess 106 such that the one or more portions of the removable applicator 108 extend substantially to the perimeter of the container 100. In some embodiments, one or more portions of the removable applicator 108 may have a width greater than the width of the recess 106 such that the one or more portions of the removable applicator 108 extend past the perimeter of the container 100. In these embodiments, the removable applicator 108 may be configured to facilitate removal of the applicators from the recess by receiving a user's finger. In some embodiments, one or more portions of the recesses may include a cut out (not shown) configured to receive a portion of a user's finger to facilitate removal of the applicators from the recess.

Figure 4:
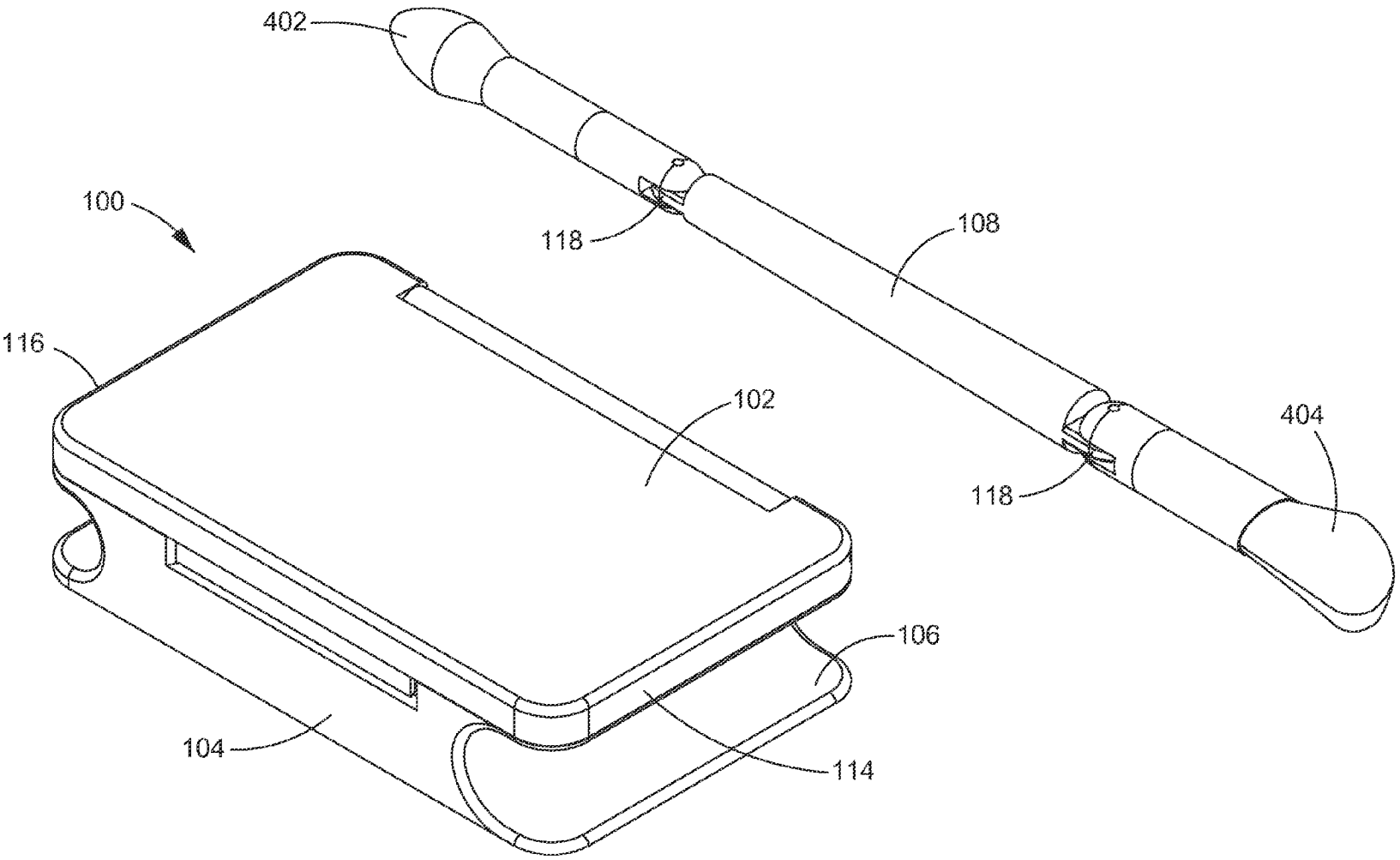
FIG. 4 is a perspective view of the container shown in FIG. 1 with the collapsible applicator removed from the container and shown in an extended application position.
Figure 5:
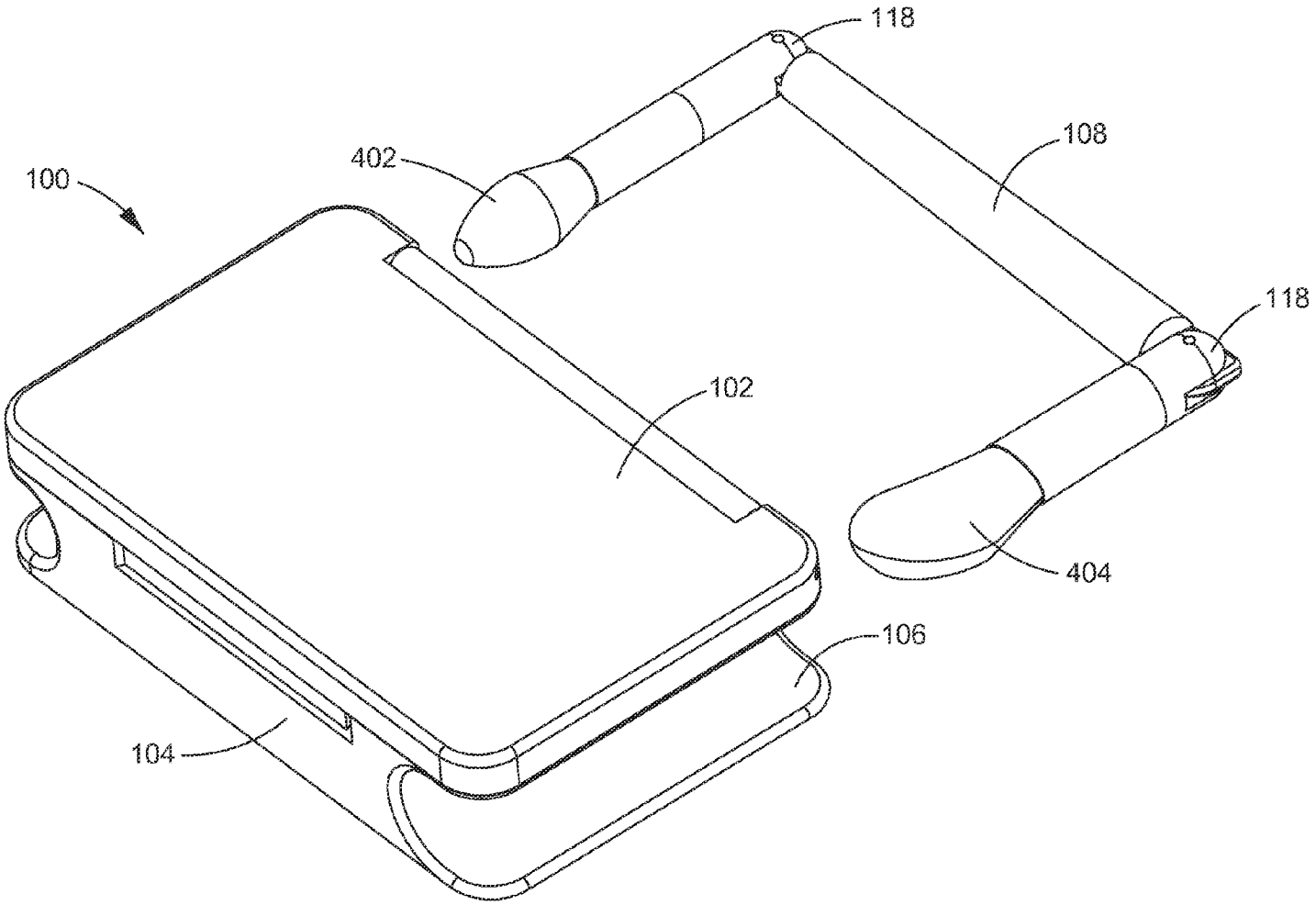
FIG. 5 is a perspective view of the container shown in FIG. 1 with the collapsible applicator removed from the container 100 and shown in a collapsed position.
Figure 6:
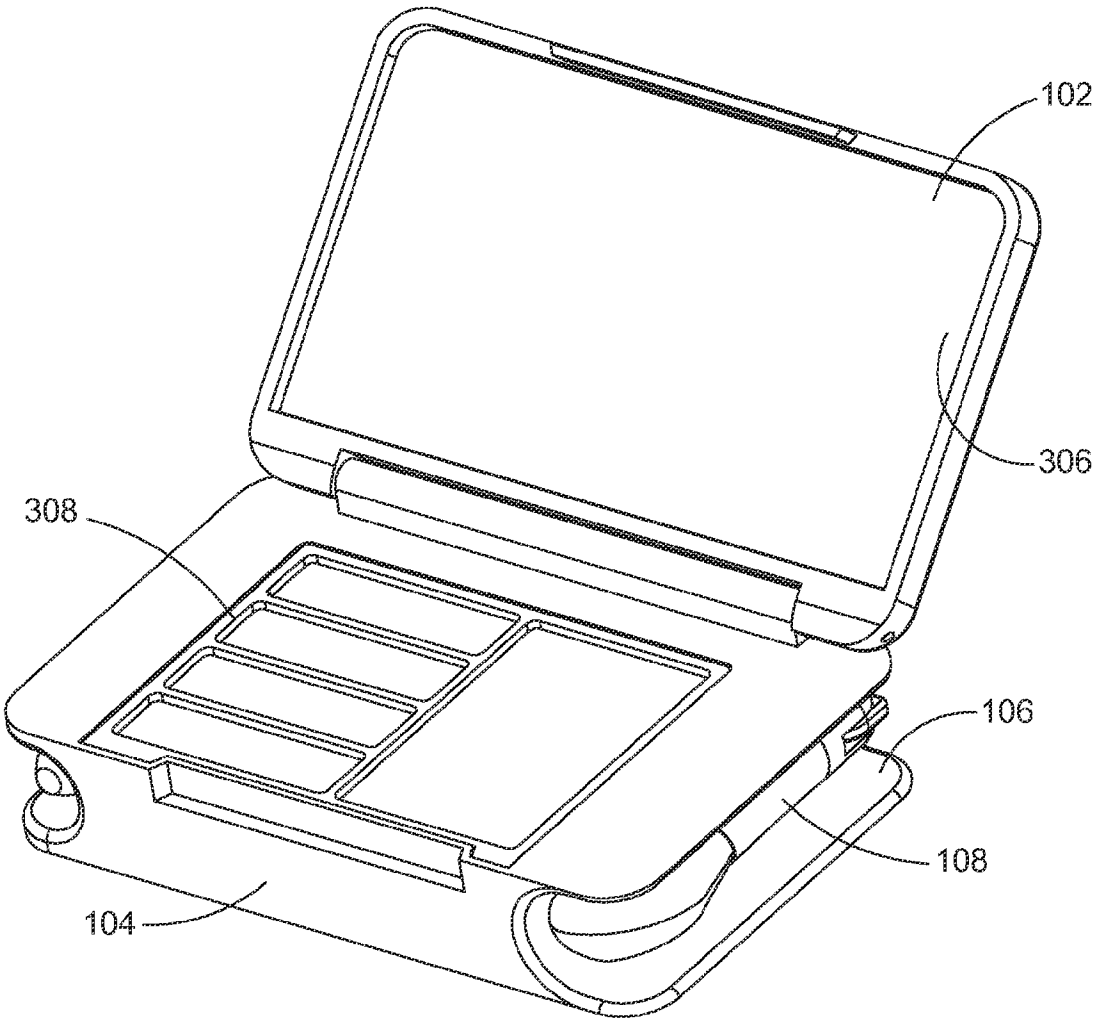
FIG. 6 is a perspective view of the container shown in FIG. 1 with the collapsible applicator in the collapsed position within the recess and the lid assembly in an open position.

FIG. 1 is a front perspective view of a container 100 in a closed state holding collapsible applicator 108 in a collapsed position. FIG. 4 is a perspective view of the container 100 shown in FIG. 1 with the collapsible applicator 108 removed from the container 100 and shown in an extended application position. FIG. 5 is a perspective view of the container 100 shown in FIG. 1 with the collapsible applicator 108 removed from the container 100 and shown in a collapsed position. FIG. 6 is a perspective view of the container 100 shown in FIG. 1 with the collapsible applicator 108 in the collapsed position within the recess 106 and the lid assembly 102 in an open position.

Movement between various exemplary states of container 100 will now be described with reference to FIG. 1 and FIG. 4 through FIG. 6. The order of movement between the states is merely exemplary and is only described for explanatory purposes. The applicator 108 may be removed from its collapsed position within recess 106 shown in FIG. 1 to its collapsed position removed from the recess 106 shown in FIG. 5. For example, a user may remove the applicator from the recess 106 by pulling the applicator 108 from the middle section between the hinged elbows 118. In this example, the recess 106 may be configured to facilitate sliding of the sections of the applicator 108 along opposing sides 114 and 116. In another example, one or more sections (e.g., section adjacent to right side 114 or section adjacent to left side 116) of the applicator 108 may be removed from the recess 106 and extended prior to removing the other sections of the applicator 108 from the recess 106. For example, the user may remove the section adjacent to right side 114 from the recess 106 and the section adjacent to left side 116 from the recess 106 such that the applicator is in an extended position and then remove the applicator 108 from the recess 106 to the position of the applicator 108 shown in FIG. 4. The container 100 may then be opened and the applicator 108 may be used to apply products within the compartments 310 in tray 308.

The container 100 may be closed by pivoting lid assembly 102 to a closed position and the applicator 108 may then be placed into the recess 106 as shown in FIG. 1, Alternatively, the applicator 108 may be first placed into the recess 106 with the lid assembly 102 open as shown in FIG. 6 prior to the lid assembly 102 being closed. Prior to being placed in the recess, the applicator 108 may be configured to be collapsed (e.g., by a user not shown) into the position shown in FIG. 5 and then placed within the recess 106. Alternatively, the applicator 108 may be configured to be positioned against or placed within a portion of the recess 106 adjacent to a side (e.g., rear side 112) while the applicator 108 is extended and then collapsed into the position shown in FIG. 5 such that each section is disposed in a corresponding side of the recess 106.

The size, shape, and dimensions of the exemplary containers shown throughout are merely exemplary. For example, exemplary containers may include outer perimeters ranging from about 80 mm to about 150 mm. Exemplary containers may also include recesses having dimensions ranging from about 6 mm to about 20 mm. Exemplary circular quick release containers may include but are not limited to the following dimensional combinations: 60×50×20 mm; 30×20×18 mm; 100×80×25 mm.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A container comprising:

a base comprising a plurality of vertical sides defining a base perimeter and having a well configured to hold a product;

a lid assembly configured to be pivotably coupled to the base;

a recess disposed on two or more of the plurality of vertical sides, the recess having a height extending between a top and bottom of the base and a width extending between the base perimeter and the well;

a collapsible applicator configured to be: (i) held within the recess at two or more of the plurality of vertical sides when the collapsible applicator is in a collapsed position; and (ii) removed from the recess at the two or more vertical sides and extended from the collapsed position to an extended application position.

2. The container according to claim 1, wherein the collapsible applicator comprises a plurality of sections that are configured to move relative to each other, and when the collapsible applicator is in the collapsed position within the recess, each of the plurality of sections is adjacent to one of the two or more vertical sides.

3. The container according to claim 1, wherein the collapsible applicator comprises:

a plurality of sections configured to move relative to each other, and one or more pivot elements joining adjacent sections of the plurality of sections, and each of the plurality of sections is configured to move relative to each other about the one or more pivot elements.

4. The container according to claim 3, wherein the one or more pivot elements comprise:

one or more hinged elbows configured to facilitate the movement of each of the plurality of sections relative to each other.

5. The container according to claim 1, wherein the base is rectangular and having a front side, a rear side opposing the front side, a right side and a left side opposing the right side, the recess disposed on the rear side, the right side and the left side, and the collapsible applicator is configured to be: (i) held within the recess at the rear side, the right side and the left side when the collapsible applicator is in a collapsed position; and (ii) removed from the recess at the rear side, the right side and the left side and extended from the collapsed position to an extended application position.

6. The container according to claim 1, wherein the collapsible applicator comprises:

a first end section, a second end section and a middle section each configured to move relative to each other, and a first hinged elbow joining the first end section and the middle section and a second hinged elbow joining the second end section and the middle section, wherein the middle section is held within the recess at the rear side when the collapsible applicator is in the collapsed position, the first end section is held within the recess at the right side when the collapsible applicator is in the collapsed position and the second end section is held within the recess at the left side when the collapsible applicator is in the collapsed position.

7. The container according to claim 1, further comprising:

another collapsible applicator configured to be: (i) held within the recess at two or more of the plurality of vertical sides when in the collapsed position; and (ii) removed from the recess at the two or more of the plurality of vertical sides and extended from the collapsed position to the extended application position.

8. The container according to claim 1, wherein the collapsible applicator is configured to be held within the recess via a magnetic connection.

9. The container according to claim 1, wherein the collapsible applicator is configured to slide into the recess.

10. A collapsible applicator for use with a container, the collapsible applicator comprising:

a first section;

a second section;

a third section;

a first pivot element joining the first section and the second section; and a second pivot element joining the second section and the third section;

wherein the first section and the second section are configured to move relative to each other about the first pivot element, and the first section and the second section are configured to be: (i) held within a recess disposed at two or more of a plurality of sides of a base of the container when the collapsible applicator is in a collapsed position; and (ii) removed from the recess at the two or more sides and extended from the collapsed position to an extend application position, wherein when the collapsible applicator is in the collapsed position, the first section of the collapsible applicator is configured to be held within the recess disposed at a right side of the container, the third section of the collapsible applicator is configured to be held within the recess disposed at a left side of the container opposing the right side of the container, and the third section of the collapsible applicator is configured to be held within the recess disposed at a rear side of the container extending between the right side and left side.

11. The collapsible applicator according to claim 10, wherein the first pivot element comprises one or more hinged elbows configured to facilitate the movement of each of the plurality of sections relative to each other.

12. The collapsible applicator according to claim 10, wherein the first pivot element comprises one or more corrugations configured to facilitate the applicator being collapsed between the collapsed position and the extended application position.

* * * * *